US007482045B2

(12) United States Patent
Ohira

(10) Patent No.: US 7,482,045 B2
(45) Date of Patent: Jan. 27, 2009

(54) GOLF BALL CONTAINER

(75) Inventor: Takashi Ohira, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 490 days.

(21) Appl. No.: 11/225,023

(22) Filed: Sep. 14, 2005

(65) Prior Publication Data

US 2006/0060489 A1 Mar. 23, 2006

(30) Foreign Application Priority Data

Sep. 17, 2004 (JP) ..... 2004-271441

(51) Int. Cl.

| | |
|---|---|
| ***B29D 22/00*** | (2006.01) |
| ***B29D 23/00*** | (2006.01) |
| ***B32B 1/08*** | (2006.01) |
| ***B41J 2/01*** | (2006.01) |
| ***B65D 85/00*** | (2006.01) |

(52) U.S. Cl. ..... 428/34.1; 347/107; 206/315.9

(58) Field of Classification Search ..... 206/315.9, 206/484.2; 428/32.11, 32.8, 34.2, 34.3, 34.1; 347/107

See application file for complete search history.

(56) References Cited

U.S. PATENT DOCUMENTS

| | | | | |
|---|---|---|---|---|
| 4,107,861 | A * | 8/1978 | Johnson | 40/654.01 |
| 5,713,803 | A * | 2/1998 | Oshima | 473/407 |
| 5,885,678 | A * | 3/1999 | Malhotra | 428/32.29 |
| 6,354,436 | B2 | 3/2002 | Ohno | |
| 6,743,490 | B2 * | 6/2004 | Fushihara et al. | 428/34.2 |

FOREIGN PATENT DOCUMENTS

| | | |
|---|---|---|
| JP | 2000-190467 A | 7/2000 |
| JP | 2000-219234 A | 8/2000 |

* cited by examiner

*Primary Examiner*—Michael C Miggins
(74) *Attorney, Agent, or Firm*—Sughrue Mion, PLLC

(57) ABSTRACT

A golf ball container having a transparent film-covered label on the exterior is obtained by using an inkjet printer to print a left-right reversed image of the label onto an ink-receiving layer on one side of the transparent film, then bonding the ink-receiving layer side of the film to the outside face of a golf ball container body. A label which includes personalized lettering or a design of limited demand can be easily and rapidly printed onto the golf ball container body at a low cost to give a high-quality golf ball container.

13 Claims, 2 Drawing Sheets

GOLF BALL CONTAINER

CROSS-REFERENCE TO RELATED APPLICATION

This non-provisional application claims priority under 35 U.S.C. §119(a) on Patent Application No. 2004-271441 filed in Japan on Sep. 17, 2004, the entire contents of which are hereby incorporated by reference.

BACKGROUND OF THE INVENTION

1. Field of the Invention

The present invention relates to a golf ball container on a surface of which is printed a label that includes lettering or a design.

2. Related Art

Golf ball boxes generally have printed on a surface thereof a label which typically includes a desired name and design. Although the printing operations for such labels ordinarily involve continuously and uninterruptedly printing the label onto a large number of boxes, the celebration of individuality today has created a commercial demand for personalized items, making it important for manufacturers and sellers of golf balls to be able to furnish in small lots golf ball boxes printed with labels that are personalized according to the consumer's desires.

However, attempts to satisfy such a desire for on-demand printing using prior-art approaches normally employed for printing a large number of boxes result in very high prices because platemaking and other costs are divided among a small number of boxes. On the other hand, the use of simplified methods for printing labels onto golf ball boxes has resulted in a lower than desirable level of quality. In particular, additional steps such as protective coating are often required to enhance quality, increasing the labor costs.

SUMMARY OF THE INVENTION

It is therefore an object of the invention to provide golf ball containers such as golf ball boxes which can be inexpensively manufactured even in small lots, yet are of a high quality.

I have found that when a label desired by the consumer is to be formed on an outside face of the body of a golf ball container such as a golf ball box, by using an inkjet printer to print a left-right reversed image of the label onto the ink-receiving layer of a transparent film having an ink-receiving layer on one side thereof, then bonding the ink-receiving layer side of the transparent film to the outside face of the container body, a golf ball container having a transparent film-covered label formed on the container outside face is obtained. Such golf ball containers are of high quality and inexpensive to produce.

Accordingly, the invention provides a golf ball container composed of a container body having an outside face, a label which includes lettering or a design and is situated on the outside face of the container body, and a transparent film which covers the label. The golf ball container is obtained by using an inkjet printer to print a left-right reversed image of a label which includes lettering or a design onto the ink-receiving layer of a transparent film having an ink-receiving layer on one side thereof, then bonding the ink-receiving layer side of the transparent film to the outside face of a container body to as to form the label on the container outside face while covering the label with the transparent film.

The container is typically in the form of a box or tube made of a paper material. Preferably, the inkjet printer uses a pigment ink. Also, it is desirable for the ink-receiving layer to have at least one water-absorbing film, in which case the ink-receiving layer preferably has a polyethylene terephthalate base.

In a preferred aspect of the invention, the container is obtained by, after printing the reversed image of the label onto the ink-receiving layer side of the transparent film, affixing this ink-receiving side of the transparent film to one side of a transparent sheet which is adhesive on both sides and affixing the outside face of the container body to the other side of the transparent sheet so as to bond together the ink-receiving layer side of the transparent film and the outside face of the container body with the transparent sheet disposed therebetween.

The golf ball container of the invention enables a label which includes personalized lettering or a design of limited demand to be easily and rapidly printed onto the golf ball container body at a low cost, and is moreover of a high-quality.

BRIEF DESCRIPTION OF THE DIAGRAMS

Figure 3:
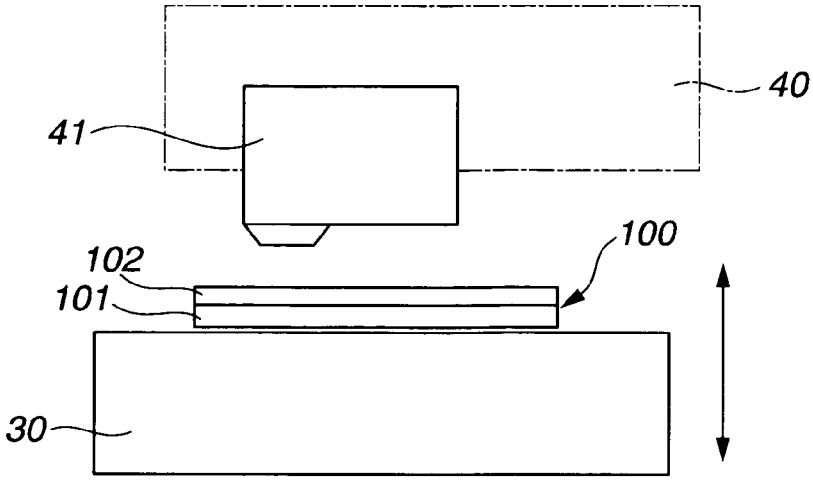

FIG. 3 schematically illustrates the printing of the label as a reverse image onto the ink-receiving layer of the transparent film with an inkjet printer in the production of a golf ball container according to the invention.

Figure 4:
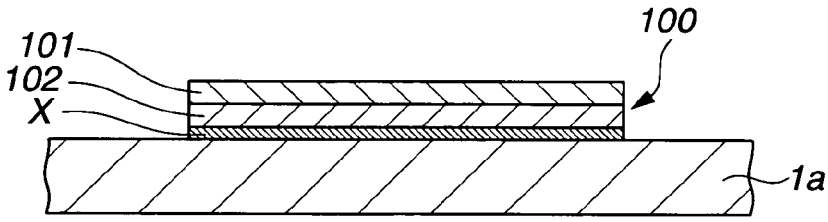

FIG. 4 is a fragmentary cross-sectional view of a laminated structure composed of the label (ink layer) that was formed on an outside face of the container body in Example 1.

Figure 5:
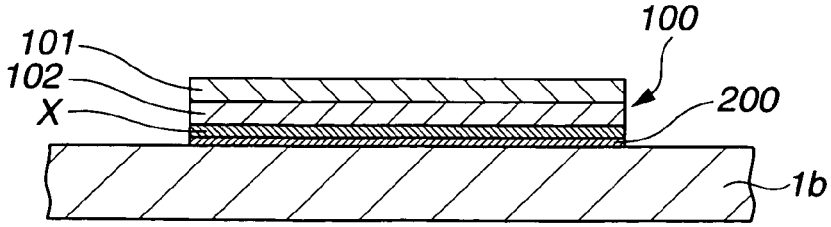

FIG. 5 is a fragmentary cross-sectional view of a laminated structure composed of the label (ink layer) that was formed on an outside face of the container body in Example 2.

DESCRIPTION OF THE PREFERRED EMBODIMENTS

The objects, features and advantages of the invention will become more apparent from the following detailed description, taken in conjunction with FIGS. 1 to 5.

Figure 1:
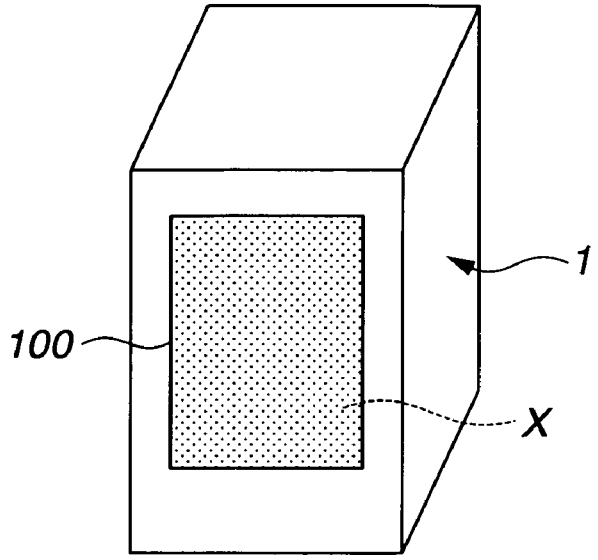
FIG. 1 is a perspective view of a golf ball box according to one embodiment of the invention.
Figure 2:
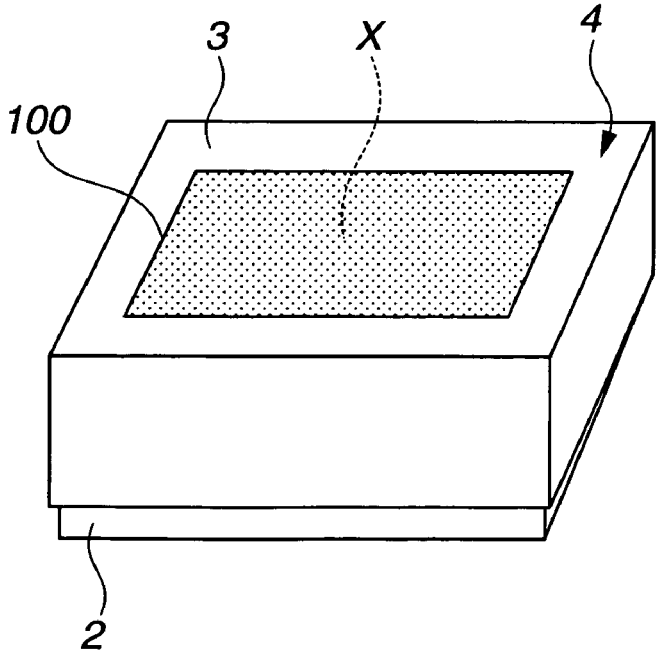
FIG. 2 is a perspective view of a golf ball box according to another embodiment of the invention.

The golf ball container of the invention is typically a box-like or tubular container made of paper or any of various types of plastic. The golf ball boxes shown in FIGS. 1 and 2 are examples of such containers. The golf ball box shown in FIG. 1 is a small box 1 of rectangular shape for holding from one to three golf balls. The golf ball box shown in FIG. 2 is a large box 4 composed of a box body 2 which is open at the top and accommodates therein several small boxes 1, and a lid 3 which fits over and covers the opening at the top of the body 2.

Examples of the material of which these golf ball boxes may be made include paperboard, film-coated paper, and various types of plastic such as polyethylene terephthalate and polypropylene. Of these, paperboard is generally used.

In the foregoing golf ball boxes, a predetermined label X (ink layer) which includes lettering or a design is formed by printing on an outside face of the body of the container such as the small box 1, the large box 4 or the lid 3. The lettering, design and other features making up the label, which are not shown, are printed with an inkjet printer. The invention is particularly useful for the on-demand printing of a personalized design for which there is only limited demand.

The inkjet printer used in the invention can be suitably selected from among known inkjet printers according to the size of the object to be printed. In terms of ink droplet discharge, use can be made of either a drop-on-demand inkjet printer such as a bubble jet, thermal jet or piezo printer, or a continuous inkjet printer such as a Hertz, Mead or Sweet-type printer.

As shown in FIG. 3, a transparent film 100 composed of a base material 101 having formed on an outer side thereof an ink-receiving layer 102 is placed on a feed tray 30 and transported by the tray 30 through a printing position in a printing unit 40 equipped with an inkjet head 41, thereby printing a predetermined label onto the ink-receiving layer 102 of the transparent film 100.

The inkjet printer may be connected to a personal computer, in which case image data for the desired label can be created using image processing software on the computer, then the image data output to the inkjet printer for printing of the desired label. In the practice of the invention, the golf ball container is obtained by using image processing software to generate reverse image data that left-right inverts the desired image, outputting this reverse image data to an inkjet printer which prints the reverse image on the ink-receiving layer of the transparent film, then bonding the image-receiving layer side of the transparent film to an outside face of the container body so as to form a positive image of the desired label on the outside face of the container body. The left-right reversed image can be easily generated by using image processing software on a computer to left-right invert the desired label.

No particular limitation is imposed on the ink used in the inkjet printer. For example, use can be made of a water-based dye, water-based pigment, oil-based pigment, water-based thermosetting acrylic pigment, solvent-based pigment or ultraviolet-curing pigment. It is generally preferable to use a pigment ink. When a dye is used, it is preferable to use an ultraviolet absorber on at least one side of the transparent film and the ink-receiving layer. In addition, the concomitant use of a light stabilizer is also preferred.

The base material of the transparent film may be a known resin material which confers transparency, particularly a thermoplastic resin. For example, use can be made of a polyethylene, polypropylene, polyethylene terephthalate or polyester plastic.

Specific examples of the primary material of which the ink-receiving layer may be made include polyvinyl alcohol, polyurethane, polyacrylamide, polyvinyl pyrrolidone, gelatin, water-soluble cellulose derivatives such as carboxymethyl cellulose, polyacrylic acid, modified polyacrylic acid, polyalkylene oxide and modified polyalkylene oxide.

In addition to the above primary material, the ink-receiving layer may also contain, for example, porous silica and alumina. If necessary, various surfactants and ink fixing agents may also be added. When a porous pigment is used in the above ink-receiving layer, it is preferable for the pigment to have an average particle size of 2 to 15 μm, a specific surface area of 120 to 500 $m^2/g$, and an oil absorption of at least 150 ml/100 g. Moreover, it is advantageous for the ink-receiving layer to be made of an ink-receiving layer composition which melts under the application of heat and thus has the ability to exhibit tackiness.

The transparent film on one surface of which an ink-receiving layer has been formed is preferably the film having an ink-receiving layer composed primarily of a water-absorbing resin on one side which is described in JP-A 2004-216570. A preferred example is the commercial film produced by Mitsubishi Plastics, Inc. under the trade name Primake HL.

When the transparent film is to be bonded at a predetermined position on a golf ball box, bonding is preferably carried out by having one side of the golf ball box face the printing side of the transparent film and laminating the two together using a suitable pressure-sensitive adhesive therebetween if necessary. If the ink-receiving layer has hot-melt or heat-sealing properties, such lamination can easily be carried out with a hot laminator.

By using a transparent, two-sided adhesive sheet and by affixing the ink-receiving layer side of the transparent film to one side of the transparent sheet and affixing the outside face of the container to the other side of the transparent sheet, the ink-receiving layer side of the transparent film and the outside face of the container can be mutually laminated with the transparent sheet disposed therebetween.

EXAMPLE 1

A label image that included predetermined lettering and a design was created using image processing software. The resulting image data was left-right inverted to generate reverse image data, based on which printing was carried out onto a transparent film 100 (see FIG. 4) as the recording medium using an inkjet printer (PM4000PX, made by Seiko Epson Corporation), thereby forming an ink layer X.

The transparent film used in this example was the product manufactured by Mitsubishi Plastics, Inc. under the trade name Primake HL. As shown in FIG. 4, this transparent film 100 was composed of a base material 101, in this case a polyethylene terephthalate film, on one side of which was laminated an ink-receiving layer 102 made primarily of a thermoplastic resin.

Next, using a heat laminator, the thermoplastic resin of the ink-receiving layer 102 was thermally melted, thereby heat-sealing the ink-receiving layer 102 side of the transparent film 100 to the paper material 1*a* of a golf ball box.

EXAMPLE 2

A predetermined label image containing lettering and a design was created using image processing software. The resulting image data was left-right inverted to generate reverse image data, based on which printing was carried out onto a transparent film 100 (FIG. 5) as the recording medium with an inkjet printer (PM4000PX, made by Seiko Epson Corporation), thereby forming an ink layer X. The transparent film 100 was the product marketed by Quick Art, Inc. under the trade name Quick Art LSSA3-C.

As shown in FIG. 5, the ink layer X bearing side of the transparent film 100 was affixed to one side of a transparent two-sided adhesive paper 200 (a product marketed under the above trade name Quick Art) to form a partial laminate, then cut away as appropriate. Next, in this partially laminated state, the other adhesive side of the adhesive paper 200 was affixed to the outside face 1*b* of a golf ball container, thereby forming the final laminated structure.

The golf ball box labels X obtained in both Examples 1 and 2 were well-defined and of high quality. In particular, because the label (ink layer) X on the box surface was covered with a transparent film 100 and thus not directly exposed to the exterior, it had an excellent durability.

Japanese Patent Application No. 2004-271441 is incorporated herein by reference.

Although some preferred embodiments of the inventive golf ball container have been described, many modifications and variations may be made thereto in light of the above teachings. For example, in cases where printing is to be carried out over the entire surface of a box, lamination may be carried while the paperboard from which the box is to be constructed is in the form of flat stock, following which the paperboard may be punched into a shape suitable for assembly into a box, then assembled into a three-dimensional box. It is therefore to be understood that the invention may be practiced otherwise than as specifically described without departing from the scope of the appended claims.

The invention claimed is:

1. A golf ball container comprising:

a container body having an outside face, a reversed image label which includes lettering or a design and is situated on the outside face of the container body, and a transparent film which covers the label;

wherein the transparent film has an ink-receiving layer on one side thereof, on which the label is printed; and the ink-receiving layer side of the transparent film is bonded to the outside face of the container body so as to form the label on the container outside face while covering the label with the transparent film;

the golf ball container being obtained by using an inkjet printer to print a left-right reversed image of the label which includes the lettering or the design onto the ink-receiving layer of the transparent film.

2. The container of claim 1 which is in the form of a box or tube made of a paper material.

3. The container of claim 1, wherein the label is printed with a pigment ink.

4. The container of claim 1, wherein after printing the label onto the ink-receiving layer side of the transparent film, the ink-receiving layer side of the transparent film is affixed to one side of a transparent sheet that is adhesive on both sides1 and the outside face of the container body is affixed to the other side of the transparent sheet so as to bond together the ink-receiving layer side of the transparent film and the outside face of the container body with the transparent sheet disposed therebetween.

5. The container of claim 1, wherein the ink used in the inkjet printer is selected from the group consisting of a water-based dye, water-based pigment, oil-based pigment, water-based thermosetting acrylic pigment, solvent-based pigment and ultraviolet-curing pigment.

6. The container of claim 1, wherein an ultraviolet absorber is used on at least one side of the transparent film and the ink-receiving layer.

7. The container of claim 1, wherein the primary material of the ink-receiving layer is selected from the group consisting of polyvinyl alcohol, polyurethane, polyacrylamide, polyvinyl pyrrolidone, gelatin, water-soluble cellulose derivatives such as carboxymethyl cellulose, polyacrylic acid, modified polyacrylic acid, polyalkylene oxide and modified polyalkylene oxide.

8. The container of claim 1, wherein the ink-receiving layer is made of an ink-receiving layer composition which melts under the application of heat and thus has the ability to exhibit tackiness.

9. The container of claim 1, wherein the ink-receiving layer is composed of at least one water-absorbing film.

10. The container of claim 9, wherein the ink-receiving layer has a polyethylene tereplithalate base.

11. A method of making the golf ball container of claim 1, comprising:

printing the left-right reversed image of the label which includes the lettering or the design on the ink-receiving layer side of the transparent film; and subsequently bonding the ink-receiving layer side of the transparent film to the outside face of the container body so as to form the label on the container outside face while covering the label with the transparent film.

12. The method of claim 11, further comprising:

after printing the left-right reversed image of the label on the ink-receiving layer side of the transparent film, affixing the ink-receiving layer side of the transparent film to one side of a transparent sheet that is adhesive on both sides; and affixing the outside face of the container body to the other side of the transparent sheet, so as to bond together the ink-receiving layer side of the transparent film and the outside face of the container body with the transparent sheet disposed therebetween.

13. The method of claim 11, wherein the label is printed by using an inkjet printer.

* * * * *